US006793996B1

(12) United States Patent
Umezawa

(10) Patent No.: US 6,793,996 B1
(45) Date of Patent: Sep. 21, 2004

(54) SHOES

(75) Inventor: Ikuko Umezawa, Hyogo (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 09/625,031

(22) Filed: Jul. 25, 2000

(30) Foreign Application Priority Data

Aug. 18, 1999 (JP) ..... 11-231136

(51) Int. Cl.[7] ..... B32B 1/00; A43B 5/00; A43B 5/02

(52) U.S. Cl. ..... 428/36.8; 420/34.1; 420/35.7; 36/129; 36/28; 36/134; 36/127; 36/596; 36/126

(58) Field of Search ..... 428/34.1; 36/129, 36/28, 134, 127, 596, 126

(56) References Cited

U.S. PATENT DOCUMENTS 3,977,096 A * 8/1976 Murray ..... 36/59 R
4,559,724 A * 12/1985 Norton ..... 36/129
5,533,282 A * 7/1996 Kataoka et al. ..... 36/129
5,922,792 A * 7/1999 Wideman et al. ..... 524/105

FOREIGN PATENT DOCUMENTS

| | | |
|---|---|---|
| JP | 622482 | 3/1994 |
| JP | 3027022 | 5/1996 |
| JP | 1189605 | 4/1999 |

* cited by examiner

*Primary Examiner*—Harold Pyon
*Assistant Examiner*—Marc Patterson
(74) *Attorney, Agent, or Firm*—Birch, Stewart, Kolasch & Birch, LLP

(57) ABSTRACT

An outsole (1) has a body (2), a spike (3), a first projected portion (4), and a second projected portion (5). The spike (3) has a disk-like portion (7) and a pin (8). The disk-like portion (7) and the pin (8) are composed of a rubber-molded material. The rubber-molded material contains 30 wt % or more of polybutadiene or acrylonitrile-butadiene copolymer as a rubber component thereof. The JIS-C hardness of the rubber-molded material is set to the range from 35 to 95 both inclusive. The cutting-time elongation of the rubber-molded material is set to 280% or more. The difference (h1–h2) between a projected height (h1) of the spike (3) and a projected height (h2) of the first projected portion (4) as well as the second projected portion (5) is set to the range from 0 mm to 15 mm both inclusive.

5 Claims, 2 Drawing Sheets

SHOES

BACKGROUND OF THE INVENTION

1. Field of the Invention

The present invention relates to shoes. In particular, the present invention relates to shoes having an outsole with a spike.

2. Description of the Related Art

When a golfer takes a shot from a tee box or fairway, the golfer swings on grass. When the golfer takes a shot from a bunker, the golfer swings on sand. If the golfer's foot slips on the ground during swinging, the golfer will make an erroneous shot. While the golfer goes round, the golfer walks on the fairway and the rough, which rises and falls. When the golfer's foot slips during walking, the golfer has an increased burden on the feet. To prevent from slipping during swinging and walking, the golfer wears golf shoes (so-called spikes) having a plurality of spikes formed on the bottom surface thereof. Each spike has a single pin formed at the center of the lower surface of the disk-shaped flange thereof and is made of a metal or ceramic material. The spike cuts into the grass, thus preventing the golfer's foot from slipping thereon.

Frequently, the golfer is required to walk not only on the grass and the sand, but also on a hard ground paved with asphalt or concrete, for example, a path located between the putting green and the tee box of a subsequent hole, a club house, and the like. The spike does not cut into the hard ground, thus being incapable of sufficiently preventing the golfer's foot from slipping thereon. Further, the spikes give the golfer a feeling that pressure is applied upward to the golfer's feet. Thus, the spikes are not comfortable to wear. Furthermore, the spike may injure the lawn (lawn on putting green in particular).

To solve the above-described disadvantages, a soft-type spike has been proposed and is coming into popular use. The soft-type spike is formed of a molded elastic material such as synthetic resin. The area of the part of the soft-type spike that contacts the ground is increased by forming many projections thereon and shaping it trapezoidally in its vertical sectional configuration. An example of a soft-type spike is disclosed in Japanese Registered Utility Model Publication No. 3027022. However, the soft-type spike is incapable of sufficiently preventing the golfer's foot from slipping on hard ground. Furthermore, there is still room for improvement of the soft-type spike to prevent slipping on wet ground in particular.

A golf shoe not having a spike but having an elastic projection formed on the bottom surface thereof is disclosed in Japanese Patent Publication 6-22482. The elastic projection prevents the golfer's foot from slipping on hard ground but hardly cuts into the lawn. Therefore, the golf shoes are incapable of sufficiently preventing the golfer's foot from slipping during swinging.

A golf shoe having a spike and a projection on the surface which contacts the ground is disclosed in Japanese Patent Application Laid-Open No. 11-89605. In the above golf shoes, the spike mainly prevents slipping on, and the projection mainly prevents slipping on hard ground.

However, the golf shoes disclosed in Japanese Patent Application Laid-Open No. 11-89605 are not satisfactory in preventing slipping on both grass and hard ground. The above golf shoes have another problem in that the spike is liable to chip and wear.

SUMMARY OF THE INVENTION

The present invention has been made in view of the above-described situation. Thus, it is an object of the present invention to provide shoes preventing a golfer's foot from easily slipping on the ground and its spike from chipping easily and wearing in a short period of time.

To achieve the object, according to the present invention, there are provided shoes having an outsole including a spike and a projected portion having a ground-contact surface formed thereon. A ground-contact portion of the spike is made of a rubber-molded material whose JIS-C hardness is set to the range from 35 to 95 both inclusive and whose cutting-time elongation is 280% or more; the rubber-molded material contains 30 wt % or more of polybutadiene as a rubber component thereof; and the difference (h1–h2) between a projected height h1 of the spike and a projected height h2 of the projected portion is set to the range from 0 mm to 15 mm both inclusive.

To achieve the object, according to the present invention, there are provided shoes having an outsole including a spike and a projected portion having a ground-contact surface formed thereon. A ground-contact portion of the spike is made of a rubber-molded material whose JIS-C hardness is set to the range from 35 to 95 both inclusive and whose cutting-time elongation is 280% or more; the rubber-molded material contains 30 wt % or more of Polybutadiene as a rubber component thereof; and the difference (h1–h2) between a projected height h1 of the spike and a projected height h2 of the projected portion is set to the range from 0 mm to 15 mm both inclusive.

Further, according to the another invention, there are provided shoes having an outsole including a spike and a projected portion having a ground-contact surface formed thereon, wherein a ground-contact portion of said spike is made of a rubber-molded material whose JIS-C hardness is set to the range from 35 to 95 both inclusive and whose cutting-time elongation is set to 280% or more; said rubber-molded material contains 30 wt % or more of acrylonitrile-butadiene copolymer as a rubber component thereof; and the difference (h1–h2) between a projected height h1 of said spike and a projected height h2 of said projected portion is set to the range from 0 mm to 15 mm both inclusive.

Accordingly, the shoes prevent slipping on both grass and hard ground. The cutting-time elongation of the rubber-molded material is set to 280% or more. Therefore, chipping of the spike can be suppressed. The rubber-molded material contains 30 wt % or more of polybutadiene or acrylonitrile-butadiene copolymer as a rubber component thereof. Thus, wear of the spike can be suppressed. The difference (h1–h2) between the projected height h1 of the spike and the projected height h2 of the projected portion is set to the range from 1 mm to 15 mm both inclusive. Therefore, it is comfortable for a golfer to wear the shoes and possible to prevent the grass from being injured.

In the case where polybutadiene is used for the spike, preferably, the polybutadiene contains a cis-1,4 linkage at 70% or more of a micro-structure thereof. Thereby, the wear of the spike can be suppressed to a higher extent.

Preferably, the spike is removably mounted on the outsole. Thereby, the spike can be replaced easily when it is worn.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The embodiment of the present invention will be described below with reference to the drawings.

Figure 1:
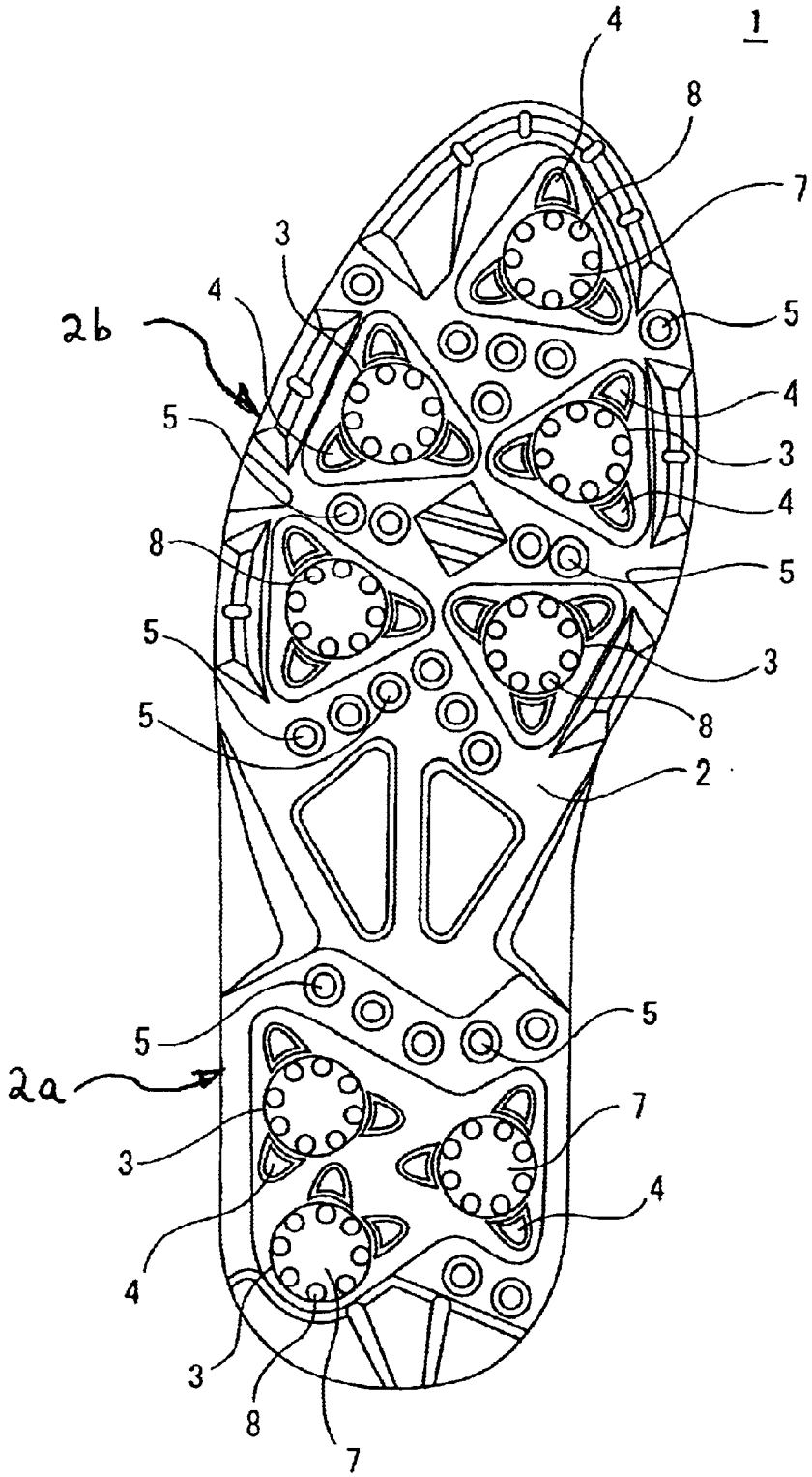
FIG. 1 is a bottom view showing golf shoes according to an embodiment of the present invention.

FIG. 1 is a bottom view showing golf shoes according to an embodiment of the present invention. An outsole 1 of the golf shoes is shown in FIG. 1. The outsole 1 has a body 2 having a heel portion 2*a* and a forefoot portion 2*b*, a spike 3, a first projected portion 4, and a second projected portion 5. Although not shown in FIGS. 1 and 2, the golf shoes have an upper part and an insole part. The construction of the upper and insole parts are similar to that of the upper and insole parts of the conventional shoes.

Figure 2:
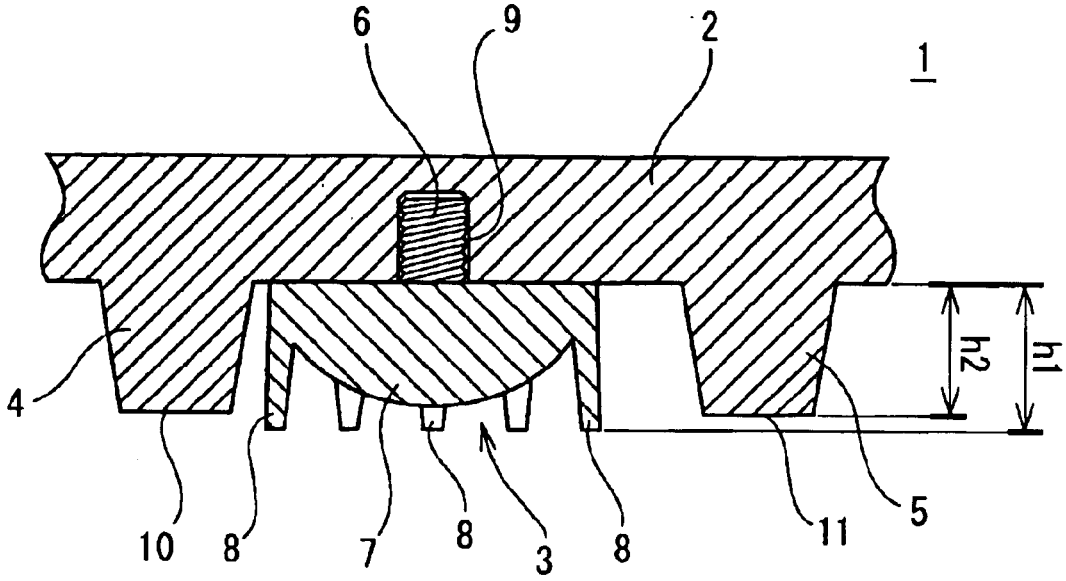
FIG. 2 is a partly enlarged sectional view showing the outsole shown in FIG. 1.

FIG. 2 is a partly enlarged sectional view showing the outsole 1 shown in FIG. 1. As apparent from FIGS. 1 and 2, the spike 3 has a screw 6, a disk-like portion 7, and pins 8. The screw 6 is made of metal. Unshown one end (lower end in FIG. 2) of the screw 6 is embedded in the disk-like portion 7. The spike 3 is fixed to the body 2 by tightening the screw 6 into a screw hole 9 formed in the body 2. Eight pins 8 are formed proximately to the peripheral edge of the disk-like portion 7, with the pins 8 spaced at regular intervals. The disk-like portion 7 and the pins 8 are formed integrally. The lower surface of the disk-like portion 7 and the pins 8 form the portion of the spike 3 that contacts the ground.

The first projected portion 4 and the second projected portion 5 are formed integrally with the body 2. The material of the first projected portion 4 and that of the second projected portion 5 are the same as that of the body 2. The first projected portion 4 and the second projected portion 5 may be formed of a material different from that of the body 2. In this case, the first projected portion 4 and the second projected portion 5 are integrated with the body 2 by bonding them to the body 2 by vulcanization. The first projected portion 4 is approximately semi-elliptic in a horizontal sectional shape and approximately trapezoidal in a vertical sectional shape. The lower end of the first projected portion 4 forms a ground-contact portion 10 having a large area. The second projected portion 5 is approximately circular in a horizontal sectional shape and approximately trapezoidal in a vertical sectional shape. The lower end of the second projected portion 5 forms a ground-contact portion 11 having a large area.

When a golfer is on grass, the pins 8 cut thereinto, thus preventing a golfer's foot from slipping thereon. When a golfer is on hard ground, the lower end of the pins 8, the ground-contact portion 10 of the first projected portion 4, and the ground-contact portion 11 of the second projected portion 5 contact the ground, thus preventing the golfer's foot from slipping thereon. Because the ground-contact portions 10 and 11 have a large area, respectively, as described above, the load is applied to the ground-contact portions 10 and 11 mainly. Accordingly, on hard ground, the golfer is greatly relieved of pressure that is applied upward to the golfer's feet.

The disk-like portion 7 and the pins 8 are composed of a rubber-molded material. As the rubber-molded material, polybutadiene (BR) or an acrylonitrile-butadiene compolymer (NBR) is used. The polybutadiene and the acrylonitrile-butadiene copolymer improve the wear resistance of the spike 3. Other rubber may be used in combination with the polybutadiene or the acrylonitrile-butadience copolymer to improve the processability of the rubber-molded material and reduce the cost of the material thereof. Rubber to be used in combination with the polybutadiene or the acrylonitrile-butadiene copolymer includes natural rubber include polyisoprene, styrene-butadiene copolymer, chloroprene rubber, ethylene-propylene-diene copolymer, butyl rubber, acrylic rubber, epichlorohydrin rubber, polysulfide rubber, and polyurethane.

In the case where any one of the above-described rubbers is used in combination with the polybutadiene or the acrylonitrile-butadiene copolymer, it is necessary to set the weight percentage of the polybutadiene or the acrylonitrile-butadiene copolymer of all rubber components to 30 or more and favorably 40 or more to maintain the wear resistance of the spike 3. The polybutadiene is inferior in kneadability. Thus, in the case where the polybutadiene is used, the weight percentage of the polybutadiene of all rubber components is set to 95 or less, and preferably, the polybutadiene is mixed with rubber (for example, polyisoprene) favorable in processability.

In the case where the polybutadiene is used, it is favorable that it contains a cis-1,4 linkage at 70% or more of its micro-structure and more favorable at 85% or more. Thereby, the spike 3 has a higher degree of wear resistance. It is also preferable to use polybutadiene containing the cis-1,4 linkage at 70% or more of its micro-structure and containing a 1,2 linkage at 2% or more of its micro-structure. The polybutadiene containing the 1,2 linkage improves the tensile strength and tear strength of the spike 3, thus suppressing growth of bending-caused cracks.

The hardness (JIS-C) of the rubber-molded material composing the disk-like potion 7 and the pin 8 is set to the range from 35 to 95 both inclusive. When the hardness of the rubber-molded material is set to 35 or more, the pin 8 is prevented from becoming too soft and thus cuts into the grass easily. Accordingly, the golfer's foot can be prevented from slipping on the grass. When the hardness of the rubber-molded material is set to 95 or less, the pin 8 is prevented from becoming too hard and thus flexes on hard ground. Consequently, the pin 8 contacts the hard ground in a large area and has a high gripping force. Accordingly, the golfer's foot can be prevented from slipping on hard ground. The flexure of the pins 8 relieves the golfer of the pressure that is applied upward to the golfer's feet from the hard ground. That is, the shoes feel comfortable to wear. From this point of view, the hardness of the rubber-molded material is set favorably to the range from 40 to 90 both inclusive and more favorably to the range from 45 to 65 both inclusive.

The cutting-time elongation of the rubber-molded material composing the disk-like portion 7 and pin 8 is set to 280% or more. When the cutting-time elongation of the rubber-molded material is 280% or more, the chipping of the spike 3 during walking is suppressed. From this point of view, the cutting-time elongation of the rubber-molded material is set to favorably 300% or more and more favorably 330% or more. It is preferable that the cutting-time elongation of the rubber-molded material is set as large as possible to prevent the disk-like in portion 7 and pin 8 from chipping. The cutting-time elongation of the rubber-molded material to be obtained normally is less than 800%.

In addition to the above-described rubbers, an appropriate amount of the following additives may be added to the rubber-molded material composing the disk-like portion 7 and the pins 8 as necessary: a filler such as carbon black, silica, calcium carbonate, and clay; and additives such as a cross-linking agent, a vulcanizing accelerator, zinc white, stearic acid, an aging resistor, a softening agent, a plasticizer, a sililation reagent, a silane coupling agent.

The difference (h1–h2) between the projected height h1 (see FIG. 2) of the spike 3 and the projected height h2 of the first projected portion 4 as well as the second projected portion 5 is set to the range from 0 mm to 15 mm both inclusive. By setting the height difference (h1–h2) to 0 mm or more, the pins 8 can cut into the grass easily. Therefore, the golfer's foot can be prevented from slipping on the grass. By setting the height difference (h1–h2) to 15 mm or less, it is possible to prevent the spike 3 from injuring the grass and allow the golfer to walk stably on hard ground. From this point of view, the height difference (h1–h2) is set favorably to the range from 2 mm to 8 mm both inclusive and more favorably to the range from 4 mm to 6 mm both inclusive.

As described previously, the disk-like portion 7 and the pins 8 of the spike 3 are composed of a rubber-molded material, and the screw 6 of the spike 3 is made of metal. However, the material of the spike 3 is not limited to these materials. For example, the screw 6 may be formed of a hard synthetic resin, and the upper part of the disk-like portion 7 may be formed of metal. In any of these modified cases, the part of the spike 3 that contacts the ground is required to be composed of the rubber-molded material.

In the outsole 1, as described previously, the spike 3 is fixed to the body 2 by tightening the screw 6 of the spike 3 into the screw hole 9 of the body 2. The tightening of the screw 6 into the screw hole 9 can be accomplished easily by turning the spike 3 with a tool such as a spike wrench. The spike 3 can be removed from the body 2 by turning the spike 3 in the opposite direction. Therefore, the spike 3 can be replaced easily when the spike 3 is worn out. The body 2 and the spike 3 may be formed by integrally molding a material. In one-piece molding, a single material is used to form the body 2 and the spike 3. Otherwise, different rubber compositions are used to form the body 2 and the spike 3 separately and they are bonded to each other by vulcanization.

The material of the body 2 is not limited to a specific one but composed of a crosslinked rubber equivalent to that of the outsole of conventional shoes. The hardness (JIS-C) of the body 2 is set favorably to the range from 20 to 80 both inclusive, more favorably to the range from 25 to 60 both inclusive, and most favorably to the range from 25 to 45 both inclusive. If the hardness is less than the lower limit of the above range, the stability of the shoes on hard ground may deteriorate. On the other hand, if the hardness is more than the upper limit of the above range, the golf shoes have a deteriorated follow-up performance for irregular ground. Thus, there is a fear that the golf shoes prevent the golfer from feeling comfortable.

The difference (C1–C2) between the hardness (JIS-C) C1 of the spike 3 at its portion that contacts the ground and the hardness (JIS-C) C2 of the body 2, the first projected portion 4, and the second projected portion 5 is set favorably to the range from 5 to 80 both inclusive, more favorably to the range from 10 to 65 both inclusive, and most favorably to the range from 15 to 50 both inclusive. If the difference (C1–C2) is less than the lower limit of the above range, it may be difficult to prevent the golfer's foot from slipping on both grass and hard ground. On the other hand, if the difference (C1–C2) is more than the upper limit of the above range, the degree of concentration of stress on the spike 3 is so high that the spike 3 is liable to wear and chip.

EXAMPLES

The effect of the present invention is clarified with reference to examples. However, needless to say, the present invention should not be limitatively interpreted based on the description of the examples.

First Example

A die having a cavity corresponding to each of the body, the first projected portion, the second projected portion, and the spike was prepared. A rubber composition composed of the following materials was prepared: 60 parts by weight of polybutadiene (vinyl cis-polybutadiene, commercial name: "Ubepol VCR-412" manufactured by Ube Kosan Inc.) containing cis-1,4 linkage at 87% of its micro-structure and 1,2 linkage at 12% of its micro-structure; 40 parts by weight of polyisoprene (commercial name: "IR2200" manufactured by Nippon Goseigomu Inc.); 60 parts by weight of silica (commercial name: "Ultra Sil VN3" manufactured by Degsa Inc.); five parts by weight of bis-(3-triethoxysilylpropyl) tetrasulfene (commercial name: "Si69" manufactuted by Degsa Inc.) serving as a silane coupling agent; two parts by weight of process oil (commercial name: "PW380" manufactured by Idemitsu Kosan Inc.); two parts by weight of 2,2'-methylene-bis (4-methyl-6-tert-butylphenol) (commercial name: "Nocrack NS-6" manufactured by Ouchi Shinko Kagaku Kogyo Inc.) serving as an aging resistor; three parts by weight of zinc white; one part by weight of stearic acid; two parts by weight of sulfur; two parts by weight of dibenzothiazolyl disulfide (commercial name: "Nocseller DM" manufactured by Ouchi Shinko Kagaku Kogyo Inc.) serving as a vulcanizing accelerator; 0.3 parts by weight of tetramethyltiuram disulfide (commercial name: "Nocseller TT" manufactured by Ouchi Shinko Kagaku Kogyo Inc.) serving as a vulcanizing accelerator; and one part by weight of vulcanizing accelerator assistant (commercial name: "Acting SL" manufactured by Yoshitomi Seiyaku Inc.). The rubber composition was filled into the cavity corresponding to the spike. Another rubber composition containing styrene-butadiene copolymer as its main component was filled into the cavity corresponding to each of the body, the first projected portion, and the second projected portion. The rubber compositions were cross-linked at 160° C. for 15 minutes to obtain an outsole. In this outsole, the spike and the body were bonded to each other by vulcanization. An upper part and an insole part were mounted on the outsole to obtain golf shoes of the first example. The height difference (h1–h2) of the golf shoes was 5 mm. The hardness of a block-shaped specimen obtained by cross-linking the rubber composition used for the spike was measured by a spring-type hardness tester C-type in conformity to JIS-K6301. As a result, the hardness of a block-shaped specimen was 55. The cutting-time elongation of a plate-shaped specimen obtained by cross-linking the rubber composition was 400% as a result of measurement conducted in conformity to JIS-K6251.

First Comparison Example

Golf shoes of the first comparison example were prepared by the same method as that of the first example, except that a die having the height difference (h1–h2) of 17 mm was used.

Second Through Fourth Comparison Examples

Golf shoes of second through fourth comparison examples were prepared by the same method as that of the first example, except that the amount of silica was varied from that of the firs example and that the amount of each of silane coupling agent and sulfur of the fourth comparison example was varied from that of the first example as shown in table 1 shown below.

Second Example

Golf shoes of the second example were prepared by the same method as that of the first example, except that polybutadiene (commercial name: "BR71" manufactured by Nippon Goseigomu Inc.) contained the cis-1,4 linkage at 35% of its micro-structure and did not contain the 1,2 linkage.

Third Example

Golf shoes of the third example were prepared by the same method as that of the first example, except that polybutadiene (commercial name: "BR60" manufactured by Unikem Inc.) contained cis-1,4 linkage at 98% of its micro-structure and did not contain 1,2 linkage.

Fourth Example

Golf shoes of the fourth example were prepared by the same method as that of the first example, except that the rubber composition contained 40 parts by weight of acrylonitrile-butadiene copolymer (commercial name: "N215SL" manufactured by Nippon Goseigomu Inc.), 2 parts by weight of dioctyl adipate (commercial name: "DOA" manufactured by Sankenkako Inc.) serving as a plasticizer, and 40 parts by weight of silica and did not contain polyisoprene and process oil.

Fifth Example

Golf shoes of the fifth example were prepared by the same method as that of the first example, except that the rubber composition did not contain polybutadiene, polyisoprene, and process oil, but contained 100 parts by weight of acrylonitrile-butadiene copolymer (commercial name: "Nipol DN401L" manufactured by Nippon Zeon Inc.), two parts by weight of a plasticizer (commercial name: "DOA").

Fifth Comparison Example

Golf shoes of the fifth comparison example were prepared by the same method as that of the first example, except that the rubber composition did not contain polybutadiene, polyisoprene, but contained 20 parts by weight of acrylonitrile-butadiene copolymer (commercial name: "N215SL"), 80 parts by weight of styrene-butadiene copolymer (commercial name: "1507" manufactured by Nippon Goseigomu Inc.), and 40 parts by weight of silica.

Reference Example

Golf shoes having the spike made of metal and a height difference (h1–h2) of 5 mm was set as the reference example.

Measurement of Worn Volume of Spike

Acron wear test (A-2 method) was conducted in conformity to JIS-K6264 to determine the worn volume of each ring-shaped specimen (diameter: 63.5 mm, thickness: 12.7 mm, and center hole: 12.7 mm) preparedly cross-linking the rubber composition used for the spike. The inclination between each specimen and a truck wheel was 15 degrees. The load applied to each specimen was 44.1N. The result is shown in table 1.

Organoleptic Evaluation 10 golfers wore the golf shoes of each of the examples and the comparison examples. They swung and walked on a putting green and walked on a path paved with concrete to evaluate the slipperiness of each of the golf shoes in 10 grades from "1" to "10". The evaluation was made by comparing each of the golf shoes with the golf shoes of the reference example whose grade was set to "5". Table 1 shows the average value of the 10 golf shoes.

Evaluation of Chipping of Spike

Whether the spikes chipped was visually checked after they walked on the path paved with concrete. Examples and comparison examples in which the golf shoes did not chip were marked as "○", those in which two golf shoes chipped was marked as "Δ", and those in which four golf shoes chipped was marked as "X". Table 1 shows the result.

Evaluation of Injury of Lawn

After they walked on the lawn, the degree of the injury of the lawn was visually checked. Examples and comparison examples in which the golf shoes injured the lawn in a low extent were marked as "○" and those in which the golf shoes injured it in a high extent were marked as "X". Table 1 shows the result.

TABLE 1

Evaluation of Golf shoes

| | CEX 1 | EX 1 | CEX 2 | CEX 3 | CEX 4 | EX 2 | EX 3 | EX 4 | EX 5 | CEX 5 | Reference Example |
|---|---|---|---|---|---|---|---|---|---|---|---|
| BR(cis-1,4: 87%, 1,2:12%) | 60 | 60 | 60 | 60 | 60 | — | — | 60 | — | — | |
| BR(cis-1,4: 35%) | — | — | — | — | — | 60 | — | — | — | — | |
| BR (cis-1,4: 98%) | — | — | — | — | — | — | 60 | — | — | — | |
| NBR N215SL | — | — | — | — | — | — | — | 40 | — | 20 | |

TABLE 1-continued

Evaluation of Golf shoes

| | CEX 1 | EX 1 | CEX 2 | CEX 3 | CEX 4 | EX 2 | EX 3 | EX 4 | EX 5 | CEX 5 | Reference Example |
|---|---|---|---|---|---|---|---|---|---|---|---|
| NBR Nipol DN401L | — | — | — | — | — | — | — | — | 100 | — | |
| IR | 40 | 40 | 40 | 40 | 40 | 40 | 40 | — | — | — | |
| SBR | — | — | — | — | — | — | — | — | — | 80 | Made of metal |
| Silica | 60 | 60 | 20 | 90 | 45 | 60 | 60 | 40 | 60 | 40 | |
| Silane coupling agent | 5 | 5 | 5 | 5 | 8 | 5 | 5 | 5 | 5 | 5 | |
| Process oil | 2 | 2 | 2 | 2 | 2 | 2 | 2 | — | — | 2 | |
| Plasticizer | — | — | — | — | — | — | — | 2 | 2 | — | |
| Sulfur | 2 | 2 | 2 | 2 | 3 | 2 | 2 | 2 | 2 | 2 | |
| Hardness (JIS-C) | 55 | 55 | 25 | 98 | 55 | 50 | 50 | 65 | 45 | 40 | |
| Cutting-time elongation (%) | 400 | 400 | 410 | 330 | 250 | 420 | 410 | 350 | 420 | 400 | |
| h1–h2 | 17 | 5 | 5 | 5 | 5 | 5 | 5 | 5 | 5 | 5 | 5 |
| Worn volume of spike (cc) | 0.05 | 0.03 | 0.06 | 0.02 | 0.03 | 0.30 | 0.01 | 0.03 | 0.04 | 1.20 | 0 |
| Slipperiness on lawn | 5.2 | 4.9 | 1.1 | 5.1 | 4.7 | 4.9 | 4.7 | 4.8 | 4.8 | 4.9 | 5.0 |
| Slipperiness on concrete | 6.1 | 8.0 | 7.2 | 2.2 | 7.9 | 7.7 | 7.7 | 8.2 | 7.6 | 8.5 | 5.0 |
| Chipping of spike | Δ | ○ | ○ | ○ | X | ○ | ○ | ○ | ○ | ○ | ○ |
| Injury of lawn | X | ○ | ○ | ○ | ○ | ○ | ○ | ○ | ○ | ○ | X |

Where CEX is comparison example and EX is example.

In table 1, the golf shoes of the examples were excellent in all evaluation items. That is, the golf shoes of the present invention have performance superior to that of the comparison examples.

As described above, the golf shoes of the present invention prevent the golfer from slipping easily, and the spike thereof does not chip or wear easily. Thus, with the shoes of the present invention on, the golfer can play without feeling uncomfortable.

What is claimed is:

1. A shoe, comprising:

an outsole including a projected portion having a ground-contact surface formed thereon, said outsole including a heel portion and a forefoot portion; and a plurality of spikes located on the heel portion and the forefoot portion of said outsole, each of said plurality of spikes being removably mounted to said outsole and including a disk shaped portion and a plurality of pins and having a ground-contact portion, an entirety of said plurality of spikes being made of a molded rubber material having a JIS-C hardness in the range from 35 to 95 and an elongation at break of 280% or more; said molded rubber material contains 30 wt % or more of polybutadlene as a rubber component thereof; the difference (h1–h2) between a projected height (h1) of said spike and a projected height (h2) of said projected portion is in the range from 2 mm to 8 mm; and a difference (C1–C2) between a hardness (C1) of the ground contact portion of the spike and a hardness (C2) of the projected portion of the outsole measured by JIS-C is in the range from 5–80.

2. The shoe according to claim 1, wherein said polybutadiene contains a cis-1,4 linkage at 70% or more in the polymer structure thereof.

3. A shoe, comprising:

an outsole including a projected portion having a ground-contact surface formed thereon, said outsole including a heel portion and a forefoot portion; and a plurality of spikes located on the heel portion and the forefoot portion of said outsole, each of said plurality of spikes being removably mounted to said outsole and including a disk shaped portion and a plurality of pins and having a ground-contact portion, an entirety of said plurality of spikes being made of a molded rubber material having a JIS-C hardness in the range from 35 to 95 and an elongation at break of 280% or more; said molded rubber material contains 30 wt % or more of acrylonitrile-butadiene copolymer as a rubber component thereof; the difference (h1–h2) between a projected height (h1) of said spike and a projected height (h2) of said projected portion is in the range from 2 mm to 8 mm; and a difference (C1–C2) between a hardness (C1) of the ground contact portion of the spike and a hardness (C2) of the projected portion of the outsole measured by JIS-C is in the range from 5–80.

4. The shoe according to claim 1, wherein said plurality of pins project from a peripheral edge of said disk shaped portion and a ground-contact portion of each of said plurality of pins projects lower than a ground-contact portion of said disk shaped portion, and when said shoe is used on a lawn, the plurality of pins cut into the lawn to prevent the shoe from slipping, while when the shoe is used on hard ground, the ground-contact portion of each of the plurality of pins is pressed by the hard ground, and the ground-contact surface of said projected portion contacts the hard ground.

5. The shoe according to claim 3, wherein said plurality of pins project from a peripheral edge of said disk shaped portion and a ground-contact portion of each of said plurality of pins projects lower than a ground-contact portion of said disk shaped portion, and when said shoe is used on a lawn, the plurality of pins cut into the lawn to prevent the shoe from slipping, while when the shoe is used on hard ground, the ground-contact portion of each of the plurality of pins is pressed by the hard ground, and the ground-contact surface of said projected portion contacts the hard ground.

* * * * *